4/7/81 XR 4,260,018 SR

United States Patent [19]

Shum et al.

[11] 4,260,018

[45] Apr. 7, 1981

[54] METHOD FOR STEAM INJECTION IN STEEPLY DIPPING FORMATIONS

[75] Inventors: Yick-Mow Shum; Wann-Sheng Huang, both of Houston, Tex.

[73] Assignee: Texaco Inc., White Plains, N.Y.

[21] Appl. No.: 85,085

[22] Filed: Dec. 19, 1979

[51] Int. Cl.[3] ..... E21B 43/24

[52] U.S. Cl. ..... 166/272; 166/273; 166/274

[58] Field of Search ..... 166/263, 268, 272, 273, 166/274

[56] References Cited

U.S. PATENT DOCUMENTS

| | | | |
|---|---|---|---|
| 2,828,819 | 4/1958 | Hughes | 166/268 X |
| 3,288,212 | 11/1966 | O'Brien et al. | 166/274 X |
| 3,319,712 | 5/1967 | O'Brien | 166/263 X |
| 3,332,485 | 7/1967 | Colburn | 166/263 X |
| 3,411,577 | 11/1968 | Altamira | 166/268 |
| 3,815,678 | 6/1974 | Terry et al. | 166/272 |
| 3,842,908 | 10/1974 | Thomas et al. | 166/268 |

*Primary Examiner*—Stephen J. Novosad
*Assistant Examiner*—George A. Suchfield
*Attorney, Agent, or Firm*—Carl G. Ries; Robert A. Kulason; Jack H. Park

[57] ABSTRACT

Steam breakthrough at the updip outcrop of a steeply dipping heavy oil reservoir is prevented by the injection of a hot water bank above the point at which the steam is injected into the heavy oil reservoir.

6 Claims, 2 Drawing Figures

WELL B
WELL A
OUTCROP
480 DAYS
540
720
900
1260
1260 DAYS
TEMPERATURE °F
DISTANCE, FEET
400
300
200
100
0
-200
-100
0
100
200
300
400
500
600

METHOD FOR STEAM INJECTION IN STEEPLY DIPPING FORMATIONS

BACKGROUND OF THE INVENTION

1. Field of the Invention

This invention pertains to the recovery of heavy oils and tars from steeply dipping reservoirs penetrated by a plurality of wells and more particularly to steam flooding operations involving same.

2. Description of the Prior Art

Petroleum reservoirs are found in an almost incredible variety. Those of interest herein are steeply dipping reservoirs which outcrop at the surface and contain predominately high viscosity petroleums fractions such as heavy oils and tars.

In a steeply dipping reservoir the most commonly used production technique is gravity drainage wherein production wells are drilled to the bottommost portions of the reservoir allowing the oil to flow downdip under the influence of gravity to the production wells wherein the petroleum is either flowed or pumped to the surface. The rate of the downward oil flow is known to be proportional to a term:

$$K_o/\mu_o(\rho_o-\rho_g)\sin\alpha$$

where $K_o$ is the oil permeability, $\mu_o$ is the oil viscosity, $\rho_o$ is oil density, $\rho_g$ is gas density, and $\alpha$ is the reservoir dip angle. For reservoirs exhibiting strong gravity drainage characteristics, the value of the above term ranges from 10–200 when $K_o$ is expressed in millidarcies, $\mu_o$ in centipoise, $\rho_o$ and $\rho_g$ in grams per cubic centimeter. It is immediately evident that for a steeply dipping reservoir containing highly viscous petroleum, the value of the above term at the initial reservoir temperature will be much less than 10 due to the high value of the oil viscosity. Basic reservoir engineering knowledge indicates that the most effective means to reduce the oil viscosity in such situations is to inject steam or hot water into the reservoir. The heat from the injected fluids serves to raise the temperature of the reservoir with a resulting reduction on the viscosity of the petroleum contained therein. Consequently, the value of the above term can be increased to within the desirable range of 10–200, thereby creating a favorable gravity drainage condition for a steeply dipping reservoir containing high viscosity petroleum.

Nevertheless, the injection of steam into the updip portion of an outcropping reservoir presents a number of problems. The optimum sequence of events for such a steam injection program would comprise first an initial mobilization of the petroleum in the vicinity of the steam injection wells formed by the formation of a bank of the mobilized oil followed by the displacement of the bank downwards toward the production wells by the continued injection of steam into the updip injection wells. Unfortunately, the natural tendency of the steam, due to its low density and high mobility, is to flow upwards in the formation to the updip limit of the reservoir at the outcrop. Indeed, uncontrolled steam injection can easily result in a condition wherein the steam front breaks through at the outcrop. Such a steam breakthrough would severely damage the reservoir's potential for further recovery of petroleum as well as create serious environmental pollution problems.

Heretofor, avoidance of steam breakthrough at the outcrop has been achieved only by those methods which employ extremely conservative steam injection rates and the shutting in of any potential steam injection wells which were felt to be in too close proximity to the outcrop. Such production practices, while prudent, will often leave substantial areas of the reservoir essentially untapped by the steam injection program due to the low injection rates and avoidance of the upper portions of the reservoir in the fear of a steam breakthrough. There remains an unmet need to utilize the full potential of an efficient steam injection program in a steeply dipping heavy oil reservoir while concurrently avoiding the problem of steam breakthrough at the outcrop.

SUMMARY OF THE INVENTION

Petroleum is recovered from an inclined reservoir which outcrops at the surface by a method which comprises injecting a fluid comprising steam into the upper portions of the reservoir through injection wells; injecting a fluid comprising heated water liquid into a buffer zone which comprises the region between the surface outcrop and the portions undergoing steam injection, said buffer zone being of a size sufficient to prevent breakthrough of the injected steam out through the outcrop; and recovering petroleum from production wells located downdip from the injection wells in a conventional manner.

DESCRIPTION OF THE PREFERRED EMBODIMENTS

Figure 1:
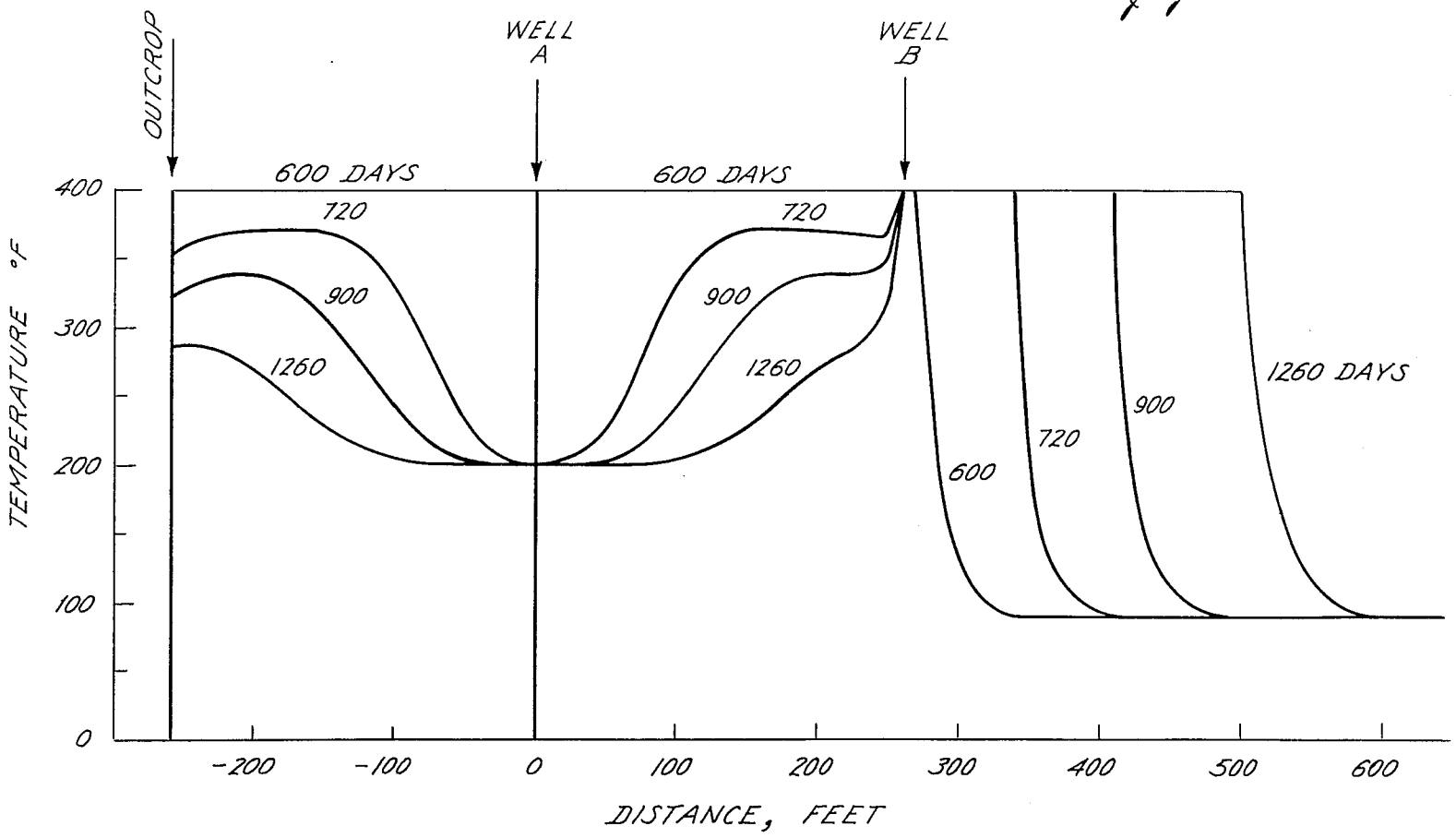
FIG. 1 represents a series of heating history curves plotted at different locations in the updip portion of the reservoir for one embodiment of the invention.
Figure 2:
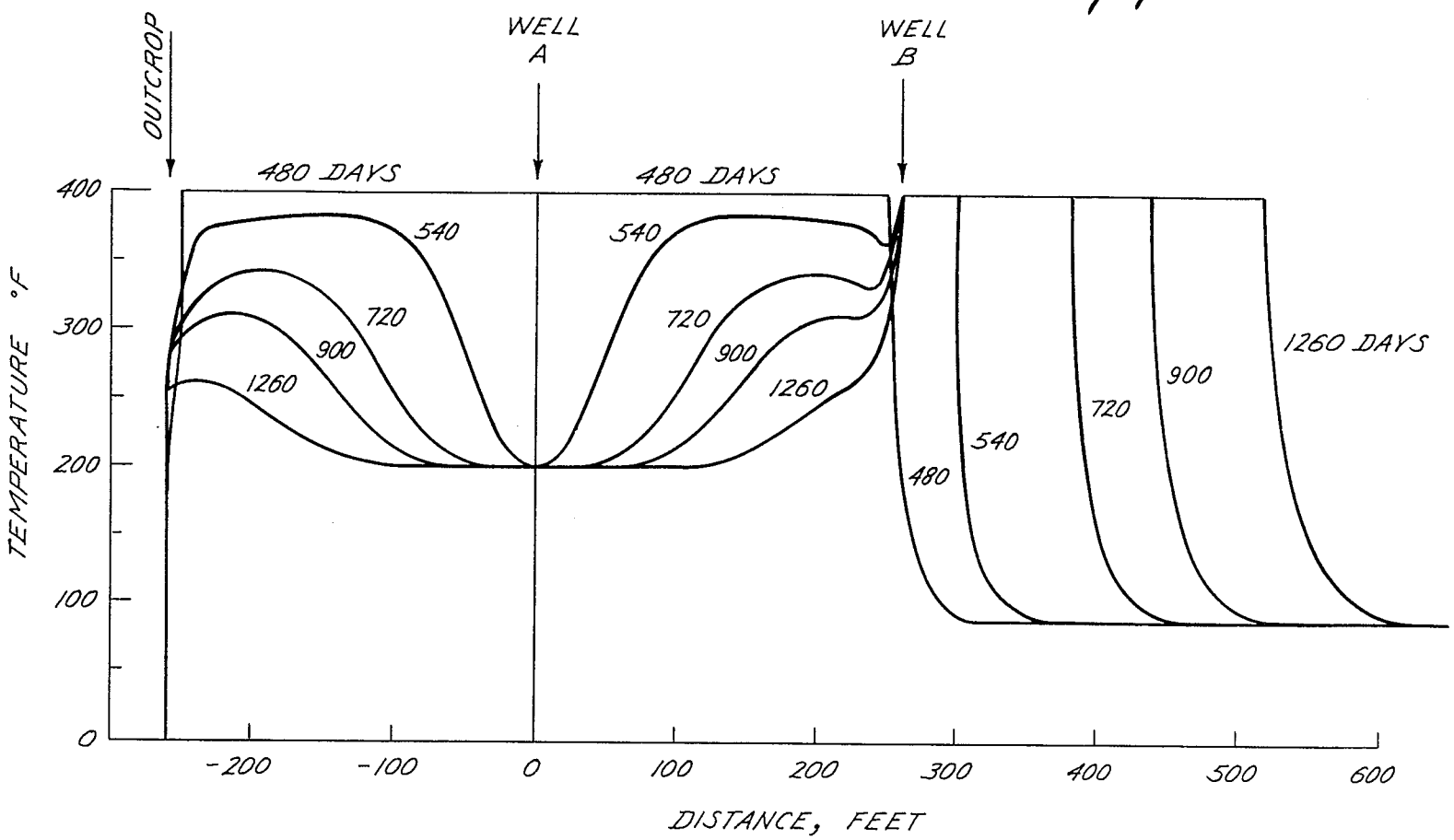
FIG. 2 represents similar information for another embodiment of the invention.

There are many petroleum reservoirs throughout the world which are of the type for which our invention is designed to be used; namely, steeply dipping reservoirs containing high viscosity petroleum which outcrop at the surface. The particular embodiments disclosed herein represent the application of the method of our invention to one particular reservoir, namely, the Tulare Zone in the Midway Sunset Field, Kern County, Calif. which contains high viscosity oil within a formation with dips in excess of 50 degrees. However, the experienced field practitioner could easily apply the method of our invention to any similar reservoir.

When a petroleum reservoir contains heavy oil or tar sands, it is accepted practice that steam or solvent injection procedures or their combinations should be used to displace the oil. When steam injection is utilized in formations which are steeply dipping and outcrop at the surface, the steam will tend to flow updip and may break through at the outcrop while the oil is being displaced in route downdip. Our invention is, therefore, to improve such a steam injection program by the injection of hot water at the well or wells closest to the outcrop at the updip end of the petroleum reservoir and to inject steam at the wells immediately adjacent on the downdip side of these hot water injection wells. The injection of water will create a high water saturation zone between the outcrop and the adjacent steam injection wells and will thus act as a "buffer zone" to prevent steam from moving toward and out through the outcrop. This injection of hot water in the updip region of the petroleum reservoir will form a water bank within the reservoir which will move downdip due to the effects of gravity. When the hot water bank contacts the steam moving updip from the downdip steam injector, the steam will be condensed and also move downdip with the hot water bank. The effect of this hot water bank is then to insulate the outcrop from the steam being injected downdip and further to mobilize and sweep downdip the petroleum remaining in the updip regions of the reservoir.

Cold water could also be injected at the updip limit of the reservoir for the purpose of insulating the outcrop from the steam injection downdip. However, it would tend to quench the steam as it entered the reservoir and make the thermal recovery process self-defeating. Nevertheless, after a significant portion of the oil in place in the updip portion of the reservoir has been moved downdip by the effects of the hot water injection, better heat utilization can be achieved by injecting cold water or produced water into the initial water injection wells at the updip limit of the reservoir. This would be combined with a progressive movement of the steam injection and hot water injection well system toward the lower portions of the reservoir.

The method of our invention was tested by a computer simulation of its use in a typical reservoir. The parameters used in this simulation are shown in Table I below. The simulation considered a system consisting of an outcrop, Well "A" 260 feet away from the outcrop and Well "B" 260 feet beyond Well "A". The simulation was run for two different systems of injection in this well system which are set forth below in the Examples 1 and 2.

TABLE I

| SIMULATION PARAMETERS | |
|---|---|
| Porosity | 0.3 |
| Pattern area | 5.0 acres |
| Sand thickness | 50.0 feet |
| Initial reservoir temperature | 90.0° F. |
| Heat capacity of reservoir | 33 Btu/ft$^3$-°F. |
| Heat capacity of cap and base rock | 36 Btu/ft$^3$-°F. |
| Thermal conductivity of reservoir | 1.0 Btu/hr-ft-°F. |
| Thermal conductivity of cap and base rock | 1.1 Btu/hr-ft-°F. |
| Initial oil saturation | 0.5 |
| Initial water saturation | 0.5 |
| Initial gas saturation | 0.0 |
| Steam injection rate | 1000 B/D |
| Steam injection temperature | 400° F. |
| Water injection rate | 1000 B/D |
| Water injection temperature | 200° F. |

EXAMPLE 1

This example represents the effects of hot water injection in Well A after steam breakthrough has occurred at the outcrop, here assumed to have taken 600 days. At this point, hot water (200° F.) is injected into Well A while steam injection is commenced at the 600 day time in Well B. FIG. 1 represents a series of temperature profiles plotted as a function of distance from the outcrop with the curved lines representing temperatures at a given point in the formation at the indicated number of days following commencement of steam injection in Well A as labeled by the specific number of days beside each temperature profile. It is evident that the injection of hot water into Well A after the 600 day time results in a significant cooling of the formation in the region between Well B and the outcrop. Although this example represents the case wherein steam has already broken through at the outcrop, it is useful to illustrate the effect of water injection to shield the outcrop region of the reservoir from the effects of steam injection at an adjacent well, here Well B.

EXAMPLE 2

In this example, the temperature of the reservoir measured at the outcrop was monitored during the course of steam injection of Well A. When the temperature at the outcrop reached 200° F., at a time of 480 days, water injection was commenced at Well A and steam injection was begun at Well B. FIG. II plotted in the manner of FIG. I for the above example, indicates that this particular injection sequence is much more effective both in shielding the outcrop from steam injection and heating the remainder of the downdip portion of the reservoir with the concurrent effect of mobilizing additional quantities of oil in a shorter period of time.

Various modifications are possible and in many cases, desirable to the basic method of our invention. In one embodiment, injection of hot water into the updip injection wells in the buffer zone may be preceded by a short period of steam injection into these wells for the purpose of mobilizing the petroleum in the immediate vicinity of the water injection wells and establishing fluid communication between the water injection wells and the steam injection wells adjacent on the downdip side. In another embodiment it may be desirable to include various chemical additives to the injected fluids, such as solvents, solubilizers, surfactants and/or caustic chemicals to enhance the oil recovery efficiency of the process as a whole. In still another embodiment, the production or injection intervals within any given well in the reservoir may be varied vertically to achieve higher sweep efficiencies during the course of the injection/production program. These and other modifications to the basic method of our invention are left to the experienced practitioner in the field.

The above examples and embodiments represent the best mode contemplated by the inventors for the practice of our invention. Nevertheless, they should not be considered as limitative and the true spirit and scope of our invention is to be found in the claims listed below.

We claim:

1. A method for recovering petroleum from an inclined reservoir which outcrops at the surface wherein the reservoir is penetrated by a plurality of wells comprising:

(a) injecting a fluid comprising steam into a steam injection zone in the upper portions of the reservoir through steam injection wells;

(b) injecting a fluid comprising heated water liquid into a buffer zone comprising the region between the surface outcrop and the steam injection zone of part (a) via heated water injection wells located updip from said steam injection wells, said buffer zone being of a size sufficient to prevent breakthrough of the injected steam at the outcrop; and, (c) recovering petroleum from production wells located downdip from both the steam and water liquid injection wells in a conventional manner.

2. The method of claim 1 wherein step (b) is preceded by the injection of steam for a period of time sufficient to mobilize the petroleum in the vicinity of the heated water injection wells and to establish fluid communication between the wells and other adjacent wells but not result in steam breakthrough at the outcrop.

3. The method of claim 1 wherein, after the oil in place within the initial buffer zone is substantially reduced, a fluid comprising unheated water liquid is injected into the wells of step (b), a fluid comprising a heater water liquid is injected into the wells of step (a) and steam is injected into further injection wells located adjacent to and immediately downdip to the wells in step (a), thereby shifting the buffer and steam injection zones downdip in the reservoir.

4. The method of claim 3 wherein the buffer and steam injection zones are sequentially shifted downdip through the reservoir a plurality of times.

5. The method of claim 3 wherein the fluid comprising unheated water liquid comprises produced water.

6. The method of claim 1 wherein the petroleum comprises a high viscosity, low gravity petroleum.

* * * * *